US009453639B2

(12) United States Patent
Mandy et al.

(10) Patent No.: US 9,453,639 B2
(45) Date of Patent: Sep. 27, 2016

(54) RECTILINEAR LIGHT SOURCE FOR ELEVATOR INTERIOR

(71) Applicant: Man-D-Tec, Inc., Scottsdale, AZ (US)

(72) Inventors: Terry Roy Mandy, Paradise Valley, AZ (US); Dalton John Mandy, Scottsdale, AZ (US); Brandon Roy Mandy, Scottsdale, AZ (US)

(73) Assignee: Mandy Holdings LLLP, Scottsdale, AZ (US)

( * ) Notice: Subject to any disclaimer, the term of this patent is extended or adjusted under 35 U.S.C. 154(b) by 115 days.

(21) Appl. No.: 14/495,665

(22) Filed: Sep. 24, 2014

(65) Prior Publication Data

US 2015/0085476 A1 Mar. 26, 2015

Related U.S. Application Data

(60) Provisional application No. 61/881,865, filed on Sep. 24, 2013.

(51) Int. Cl.
*F21V 29/77* (2015.01)
*F21S 8/02* (2006.01)
(Continued)

(52) U.S. Cl.
CPC ..... *F21V 29/773* (2015.01); *B66B 11/0233* (2013.01); *F21S 8/026* (2013.01);
(Continued)

(58) Field of Classification Search
CPC .... F21V 29/773; F21V 29/75; F21V 29/507; F21V 7/048; F21V 7/09; F21V 7/04; F21V 7/0025; F21V 7/10; F21V 7/005; F21V 21/046; F21V 21/04; F21V 21/30; F21V 13/04; F21V 15/01; B66B 11/0233; F21S 8/026; F21S 8/02; F21Y 2103/003; F21Y 2101/02
USPC ..... 362/147–150, 157, 190–191, 217.01, 362/219, 217.02, 217.05–217.07, 362/217.1–217.17, 249.01–249.02, 249.11, 362/257, 296.01, 297, 300, 302, 307, 310, 362/296.05–296.08, 341, 343, 350, 362, 362/364–366, 368
See application file for complete search history.

(56) References Cited

U.S. PATENT DOCUMENTS 1,767,988 A 6/1930 Knapp
2,835,791 A 5/1958 Horwitz
(Continued)

FOREIGN PATENT DOCUMENTS

EP 0495273 A1 7/1992
WO 03019073 A1 3/2003
(Continued)

OTHER PUBLICATIONS

Installation guide for IP110-F Flush Mount Adapter, Pelco, Inc., Dec. 2008, C2238M, 8 pages.
(Continued)

*Primary Examiner* — Anne Hines
*Assistant Examiner* — Jose M Diaz
(74) *Attorney, Agent, or Firm* — Reising Ethington P.C.

(57) ABSTRACT

An elevator interior illumination assembly for providing a rectilinear source of illumination in an elevator ceiling panel. An LED, reflector, and a rectilinear lens are carried by the housing, and the reflector and lens are configured to direct light emitted by the LED into an evenly-distributed rectilinear light emission image across the lens.

20 Claims, 5 Drawing Sheets

(51) Int. Cl.

| | |
|---|---|
| ***B66B 11/02*** | (2006.01) |
| *F21Y 101/02* | (2006.01) |
| *F21V 7/00* | (2006.01) |
| *F21V 7/04* | (2006.01) |
| *F21V 21/04* | (2006.01) |
| *F21Y 103/00* | (2016.01) |
| *F21V 29/507* | (2015.01) |
| *F21V 29/75* | (2015.01) |

(52) U.S. Cl.

CPC ..... *F21V 7/005* (2013.01); *F21V 7/048* (2013.01); *F21V 21/046* (2013.01); *F21V 29/507* (2015.01); *F21V 29/75* (2015.01); *F21Y 2101/02* (2013.01); *F21Y 2103/003* (2013.01)

(56) References Cited

U.S. PATENT DOCUMENTS 3,189,788 A 6/1965 Cady
3,294,977 A 12/1966 Duncan
3,336,473 A 8/1967 Buzan
3,748,460 A * 7/1973 Price ..... F21S 8/02 362/347
3,760,179 A 9/1973 Addington, Jr.
3,808,499 A 4/1974 Edwards
4,013,993 A 3/1977 Mandel et al.
4,032,828 A 6/1977 Strobl et al.
4,039,822 A 8/1977 Chan et al.
4,056,757 A 11/1977 Mauch et al.
4,071,749 A 1/1978 Balogh
4,156,891 A 5/1979 Roche
4,218,725 A 8/1980 Heffner et al.
4,223,232 A 9/1980 Bulat
4,234,907 A 11/1980 Daniel
4,241,871 A 12/1980 Newell, III et al.
4,271,621 A 6/1981 Garcia et al.
4,441,143 A 4/1984 Richardson, Jr.
4,504,894 A 3/1985 Reibling
4,520,436 A 5/1985 McNair et al.
4,587,597 A 5/1986 Meyers
4,682,078 A 7/1987 Pascilade
4,697,890 A 10/1987 Crookston et al.
4,708,223 A 11/1987 Orndorff et al.
4,727,291 A 2/1988 Bavaria
4,749,908 A 6/1988 Sifter
4,751,398 A 6/1988 Ertz, III
4,802,065 A 1/1989 Minter et al.
4,875,553 A 10/1989 Smith et al.
4,885,663 A 12/1989 Parker
4,890,200 A 12/1989 Mandy
4,905,579 A 3/1990 Dame
4,907,132 A 3/1990 Parker
4,947,291 A 8/1990 McDermott
4,977,818 A 12/1990 Taylor et al.
5,003,432 A 3/1991 Mandy
5,005,108 A 4/1991 Pristash et al.
5,021,928 A 6/1991 Daniel
5,025,349 A 6/1991 Gow
5,123,875 A 6/1992 Eubank et al.
5,145,247 A 9/1992 Mandy
5,161,879 A 11/1992 McDermott
5,172,976 A * 12/1992 Bogdanovs ..... F21V 17/107 362/223
5,253,152 A 10/1993 Yang et al.
5,408,394 A 4/1995 Mandy
5,412,542 A 5/1995 Mandy
5,568,964 A 10/1996 Parker et al.
5,613,751 A 3/1997 Parker et al.
5,618,096 A 4/1997 Parker et al.
5,661,645 A 8/1997 Hochstein
5,739,639 A 4/1998 Johnson
5,850,126 A 12/1998 Kanbar
5,876,107 A 3/1999 Parker et al.
5,894,686 A 4/1999 Parker et al.
5,895,115 A 4/1999 Parker et al.
5,905,923 A * 5/1999 Chitsaz ..... F16C 33/26 248/183.3
5,921,652 A 7/1999 Parker et al.
5,921,670 A 7/1999 Shumacher et al.
5,966,069 A 10/1999 Zmurk et al.
6,030,089 A 2/2000 Parker et al.
D423,692 S * 4/2000 Hashizume ..... D26/1
6,079,838 A 6/2000 Parker et al.
6,158,867 A 12/2000 Parker et al.
6,185,356 B1 2/2001 Parker et al.
6,609,804 B2 8/2003 Nolan et al.
6,712,481 B2 3/2004 Parker et al.
6,752,505 B2 6/2004 Parker et al.
6,764,196 B2 7/2004 Bailey
6,824,317 B2 * 11/2004 Finizio ..... G03B 17/00 348/143
6,827,456 B2 12/2004 Parker et al.
6,860,628 B2 3/2005 Robertson et al.
6,872,220 B2 3/2005 Williams et al.
6,874,925 B2 4/2005 Page et al.
6,994,457 B2 2/2006 Lee
7,066,617 B2 6/2006 Mandy et al.
7,071,625 B2 7/2006 Cheng et al.
7,077,544 B2 7/2006 Parker
7,114,829 B2 10/2006 Lai
7,114,830 B2 * 10/2006 Robertson ..... F21K 9/17 362/217.07
7,234,844 B2 * 6/2007 Bolta ..... F21V 5/002 362/249.02
7,246,926 B2 * 7/2007 Harwood ..... F21S 2/00 362/234
7,261,453 B2 8/2007 Morejon et al.
7,387,410 B2 * 6/2008 Sibout ..... B60Q 3/025 16/254
7,396,139 B2 * 7/2008 Savage ..... B63B 45/02 362/101
7,486,033 B2 2/2009 Chen et al.
7,520,686 B2 * 4/2009 Droege ..... G03B 17/02 348/143
7,620,211 B2 * 11/2009 Browne ..... G01N 21/59 356/435
7,670,021 B2 * 3/2010 Chou ..... F21S 8/026 362/147
D614,801 S * 4/2010 Collins ..... D26/118
7,722,227 B2 5/2010 Zhang et al.
7,766,511 B2 * 8/2010 Zampini ..... F21S 2/00 362/294
7,889,430 B2 * 2/2011 El-Ghoroury ..... H04N 5/74 359/641
7,896,517 B2 3/2011 Mandy et al.
8,038,314 B2 * 10/2011 Ladewig ..... F21V 7/0008 362/217.12
8,042,977 B1 * 10/2011 Nourishad ..... F21S 2/005 362/217.05
8,045,168 B2 * 10/2011 Missotten ..... A01D 41/127 356/445
8,066,407 B2 * 11/2011 Remus ..... F21S 8/06 362/147
8,092,035 B2 1/2012 Mandy et al.
8,096,672 B2 1/2012 Mandy et al.
8,251,541 B2 * 8/2012 Lin ..... F21V 15/01 315/291
8,297,798 B1 * 10/2012 Pittman ..... F21S 8/026 362/241
8,360,620 B1 * 1/2013 Rashidi ..... F21S 9/022 362/217.01
8,382,340 B2 * 2/2013 Boyer ..... F21S 8/02 362/147
D690,875 S * 10/2013 McKenzie ..... D26/118
8,558,407 B2 10/2013 Mandy et al.
8,585,241 B2 * 11/2013 Tsai ..... F21S 8/026 362/217.01
8,702,264 B1 * 4/2014 Rashidi ..... F21S 8/026 362/147
8,864,340 B2 * 10/2014 Holland ..... F21V 7/0066 362/147
D717,487 S * 11/2014 Guzzini ..... D26/118

(56) References Cited

U.S. PATENT DOCUMENTS 8,888,326 B2 * 11/2014 Hatch ..... F21V 15/01 362/147
8,963,450 B2 * 2/2015 Maxik ..... H05B 33/0869 315/307
9,004,713 B2 4/2015 Mandy et al.
9,068,716 B2 * 6/2015 Kang ..... F21V 7/048
D738,032 S * 9/2015 Maxik ..... D26/118
D740,996 S * 10/2015 Tragatschnig ..... D26/118
9,182,091 B2 * 11/2015 Gershaw ..... F21S 8/04
9,200,784 B2 * 12/2015 Mandy ..... F21V 19/0015
9,206,948 B1 * 12/2015 Scribante ..... F21K 9/17
2004/0125246 A1 7/2004 Okamori et al.
2004/0257807 A1 * 12/2004 Endo ..... B66B 11/0233 362/247
2005/0190345 A1 9/2005 Dubin et al.
2006/0038192 A1 2/2006 Williams
2006/0187654 A1 8/2006 Jungel-Schmid et al.
2007/0195532 A1 8/2007 Reisenauer
2007/0242461 A1 10/2007 Reisenauer et al.
2007/0247850 A1 * 10/2007 Hawkins ..... F21V 25/00 362/267
2008/0024010 A1 1/2008 Romano
2008/0084700 A1 4/2008 Van de Ven
2008/0192489 A1 8/2008 Ward
2008/0232116 A1 * 9/2008 Kim ..... F21S 8/026 362/365
2008/0258628 A1 10/2008 Higley et al.
2008/0278950 A1 * 11/2008 Pickard ..... F21S 8/02 362/294
2008/0278957 A1 * 11/2008 Pickard ..... F21S 8/02 362/373
2008/0285271 A1 * 11/2008 Roberge ..... F21S 8/033 362/235
2008/0296975 A1 12/2008 Shakespeare et al.
2009/0103288 A1 * 4/2009 Boyer ..... F21V 7/04 362/153.1
2009/0147517 A1 * 6/2009 Li ..... F21V 21/046 362/249.02
2009/0290361 A1 11/2009 Ruud et al.
2010/0085767 A1 * 4/2010 Boyer ..... F21S 8/02 362/368
2011/0044047 A1 2/2011 Mandy et al.
2011/0299290 A1 12/2011 Mandy
2012/0120645 A1 * 5/2012 Hawkins ..... F21V 31/005 362/225
2012/0140461 A1 * 6/2012 Pickard ..... F21V 15/013 362/225
2012/0187852 A1 7/2012 Mandy et al.
2012/0262902 A1 * 10/2012 Pickard ..... F21S 8/026 362/84
2012/0327650 A1 * 12/2012 Lay ..... F21V 13/04 362/231
2013/0021792 A1 * 1/2013 Snell ..... F21S 2/00 362/218
2013/0021803 A1 * 1/2013 Pickard ..... F21V 7/22 362/308
2013/0120963 A1 * 5/2013 Holland ..... F21V 7/0066 362/84
2013/0223055 A1 * 8/2013 Holland ..... F21V 7/005 362/218
2013/0335962 A1 * 12/2013 Wu ..... F21V 5/004 362/235
2014/0055995 A1 * 2/2014 Kang ..... F21V 7/048 362/235
2014/0165492 A1 * 6/2014 Friedman ..... E04F 13/0805 52/506.05
2014/0252948 A1 9/2014 Mandy et al.
2014/0268649 A1 9/2014 Mandy et al.
2014/0268823 A1 9/2014 Mandy et al.
2014/0268829 A1 9/2014 Mandy et al.

FOREIGN PATENT DOCUMENTS

WO 2005098806 10/2005
WO 2006031350 A2 3/2006

OTHER PUBLICATIONS

Search Report from the Intellectual Property Office for German Application No. GB1204033.3, dated Jun. 14, 2012; 1 page.

* cited by examiner

RECTILINEAR LIGHT SOURCE FOR ELEVATOR INTERIOR

CROSS-REFERENCES TO RELATED APPLICATIONS

This patent application claims the benefit of the filing date of U.S. Provisional Patent Application Ser. No. 61/881,865 filed Sep. 24, 2013.

STATEMENT REGARDING FEDERALLY SPONSORED RESEARCH OR DEVELOPMENT

Not Applicable

BACKGROUND

1. Field

This application relates generally to elevator interior illumination.

2. Description of Related Art including Information Disclosed under 37 CFR 1.97 and 1.98

Elevator illumination assemblies or fixtures that include LED lamps as light sources and that are installed such that they are at least partially recessed in elevator ceiling panels, generally have circular face plates, lenses, and reflectors so that, as viewed from below, a circular illumination image is presented at the lens. Those having rectangular or square frames or face plates and/or square lenses also generally have circular reflectors—resulting in a circular illumination image being transmitted through a square lens and or face plate with dark areas presented in corners of the lens.

SUMMARY

An elevator interior illumination assembly is provided for providing a rectilinear source of illumination in an elevator ceiling panel. The assembly comprises a housing, an LED carried by the housing, a reflector carried by the housing, and a rectilinear lens carried by the housing. The reflector and lens are configured to direct light emitted by the LED into an evenly-distributed rectilinear light emission image across the lens.

DRAWING DESCRIPTIONS

These and other features and advantages will become apparent to those skilled in the art in connection with the following detailed description and drawings of one or more embodiments of the invention, in which.

DETAILED DESCRIPTION

Figure 1:
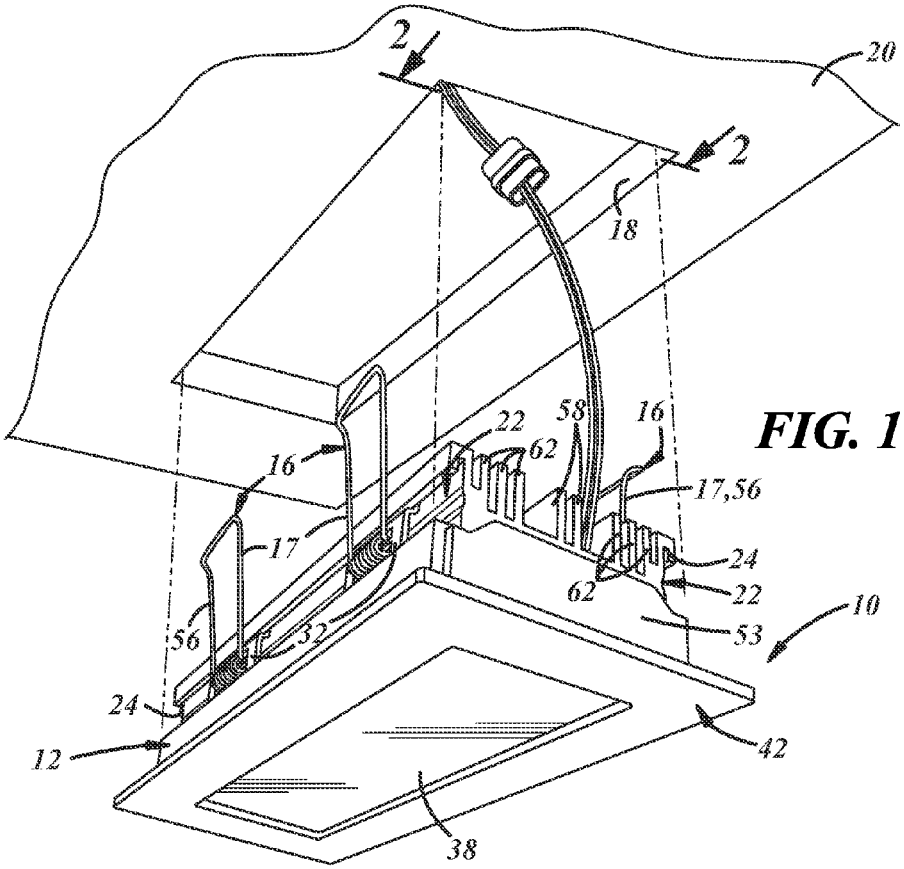
FIG. 1 is a perspective view of an elevator interior illumination assembly having a rectangular housing and shown spaced below a rectangular ceiling panel hole into which the assembly is to be received.
Figure 2:
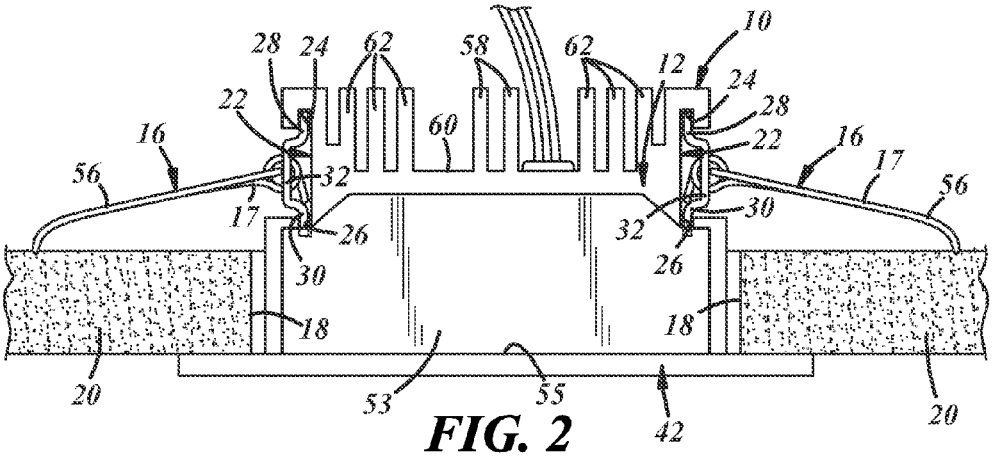
FIG. 2 is an end view of the assembly of FIG. 1 shown installed in a ceiling panel.

A first embodiment of an elevator interior illumination assembly for providing a rectilinear, rather than circular, source of illumination in an elevator ceiling panel is generally shown at 10 in FIGS. 1-6. A second embodiment is generally shown at 10' (10 prime) in FIGS. 7-9. According to the first embodiment, the assembly 10 has a generally rectangular configuration and produces a rectangular illumination image. According to the second embodiment, the assembly 10' has a generally square configuration and a produces a square illumination image. Reference numerals with the designation prime (') in FIGS. 7-9 indicate elements of the second embodiment that are alternative configurations of elements that appear in the first embodiment, in FIGS. 1-6. Unless indicated otherwise, where a portion of the following description uses a reference numeral to refer to FIGS. 1-6, that portion of the description applies equally to elements designated by primed numerals in FIGS. 7-9. Additionally, the descriptions of the embodiments are incorporated by reference into one another and the common subject matter generally may not be repeated here.

As shown in FIGS. 1-6, the assembly may include a housing 12 carrying at least one, and preferably a plurality, of LEDs 14. The housing 12 may comprise aluminum or any other suitable extrudable material. The assembly 10 may also include at least one, and preferably a plurality, of retainers 16 adapted to be carried by the housing 12 and to secure the housing 12 in a hole 18 in a panel 20. Each retainer 16 may comprise a spring clip 17. The housing 12 may comprise a length of extruded material. Accordingly, the housing 12 can be fabricated in a broad range of lengths to suit various applications and aesthetic preferences by extruding a desired material, preferably aluminum, in a desired cross-sectional shape, and then cutting the extrusion to a desired length.

Figure 3:
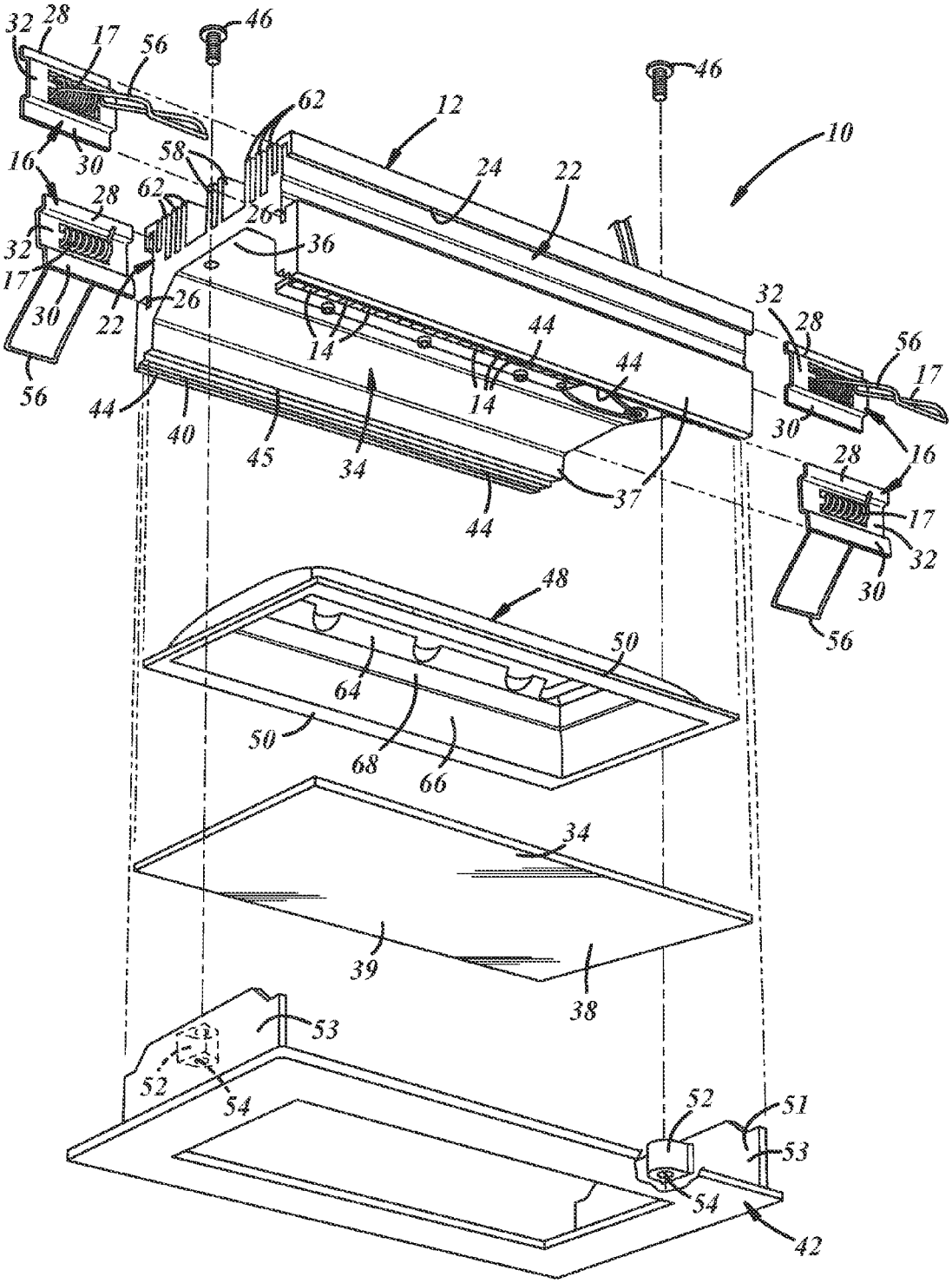
FIG. 3 is an exploded view of the assembly of FIG. 1.

As best shown in FIGS. 1-4, the housing 12 may include at least one side channel 22, and preferably a pair of opposite side channels 22, each configured to slidably receive the retainers 16. The side channels 22 may each comprise an elongated track of generally T-shaped cross-section and having upper and lower grooves 24, 26 configured to receive respective upper and lower edges 28, 30 of a base 32 of each retainer 16. This allows for different quantities of retainers 16 to be installed in the side channels 22 to suit different mounting applications and also provides a way of rapidly attaching any one of a number of different types of retainers 16 capable of holding the assembly 10 in a hole 18 in a panel 20. As best shown in FIG. 3, four retainers may be carried by the housing 12 with two retainers 16 received in spaced-apart positions in each of the two side channels 22.

Any suitable number of retainers 16 may be mounted on the assembly 10, and the number selected for mounting may be based on a selected length of the housing 12. The retainer 16 and housing 12 may be configured to be slightly smaller in lateral dimensions than a ceiling panel hole 18 into which they are to be received and then secured by the retainers 16.

Figure 4:
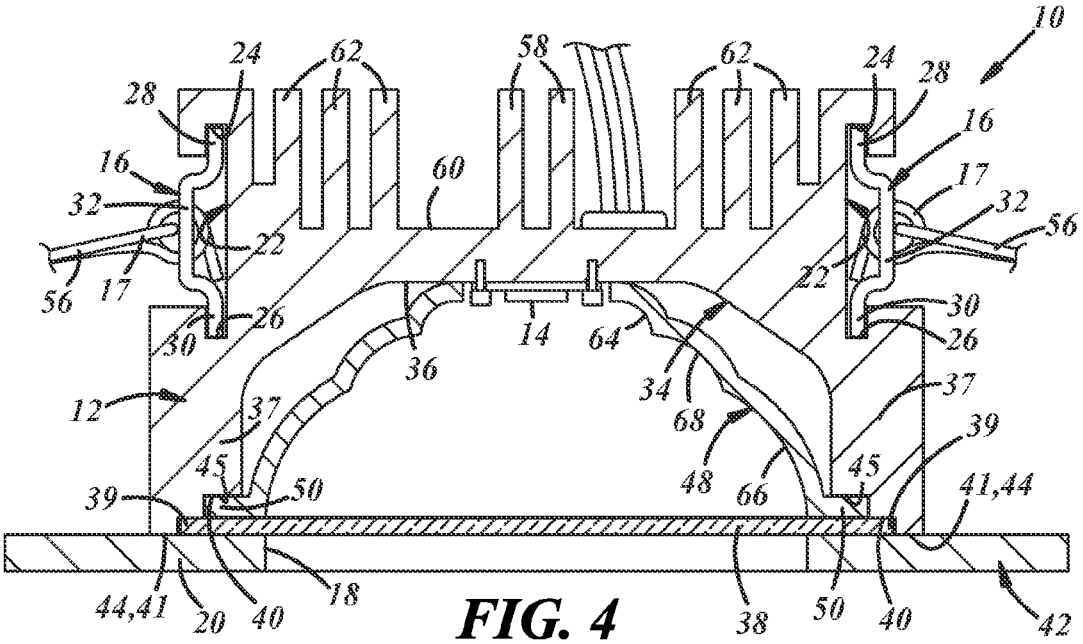
FIG. 4 is an cross-sectional end view of the assembly of FIG. 1.
Figure 5:
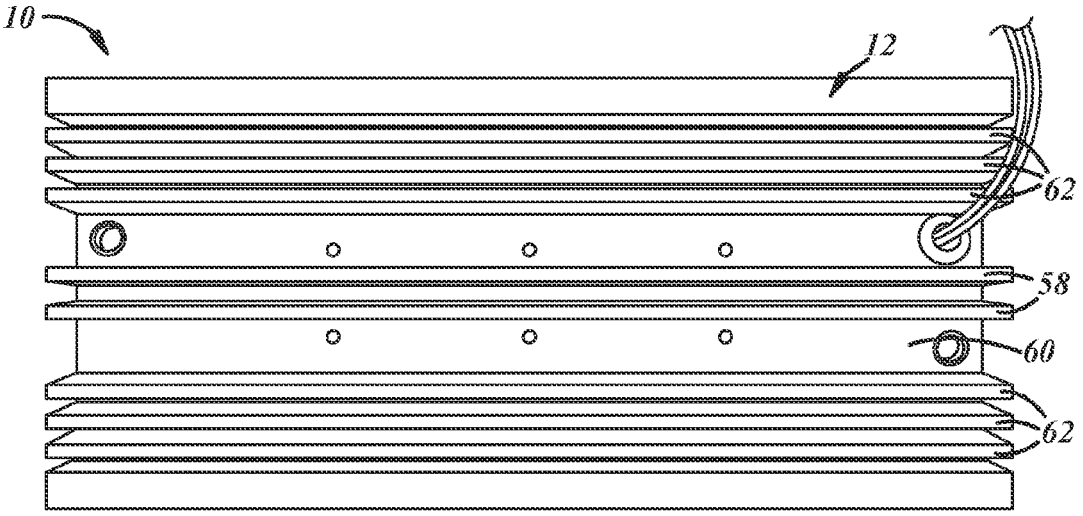
FIG. 5 is a top view of the assembly of FIG. 1.

As shown in FIGS. 3 and 4, each housing 12 may include a front channel 34 defined by a channel floor 36 and channel side walls 37. The LEDs 14 may be carried on the channel floor 36. The front channel 34 may be closed by a lens 38 received in a pair of outer step surfaces 40 disposed along respective forward edges 41 of the channel side walls 37. As best shown in FIG. 4, the lens 38, which may comprise a polycarbonate sheet or any other suitable material, may be held at opposite side edges 39 against the outer step surfaces 40 by a front face plate 42. The front face plate 42 may comprise a frame-shaped trim piece shaped to frame the lens 38 while securing the opposite side edges 39 of the lens 38 against the outer step surfaces 40 of the channel side walls 37. The lens 38 may be cut to a length generally equal to that of the housing 12, and the front face plate 42 may be fabricated to have a length and width greater than a length and width of the housing 12. The lens 38 may be sealed against the outer step surfaces 40 by the front face plate 42.

Figure 6:
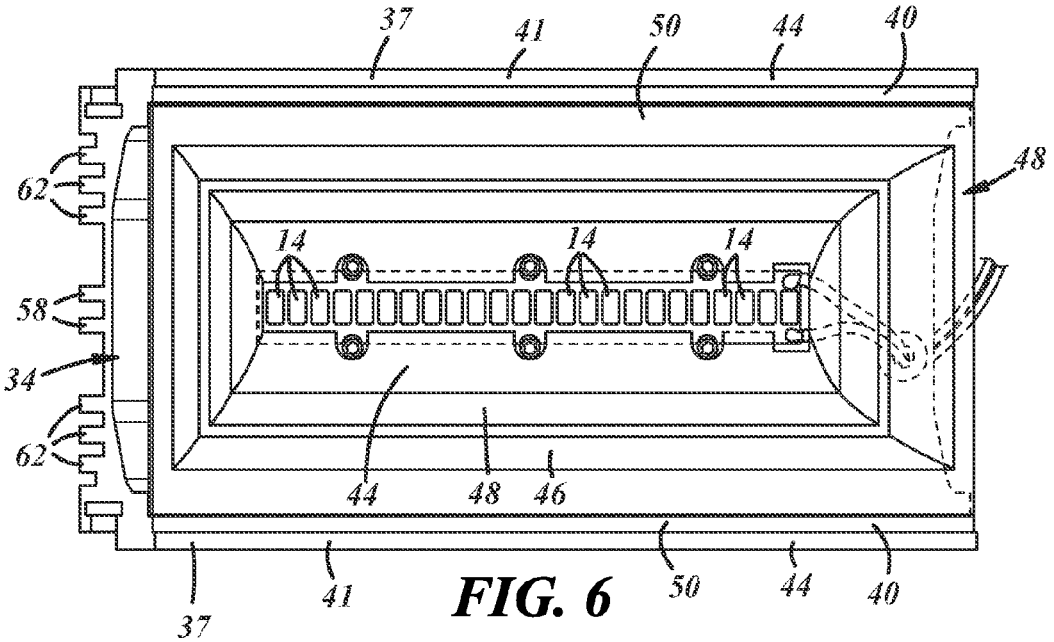
FIG. 6 is a bottom view of the assembly with lens and front face plate components of the assembly removed to show the relationship between LEDs and a reflector of the assembly.

As shown in FIGS. 3, 4, and 6, the forward edges 41 of the channel side walls 37 may include respective front surfaces 44 disposed in a common front plane. As best shown in FIG. 4, the respective outer step surfaces 40 may be recessed from the respective front surfaces 44 and disposed in a common inner recessed plane spaced from and generally parallel to the front plane. As best shown in FIG. 3, the front face plate 42 may be drawn toward and/or engaged against the front surfaces 44 of the side wall forward edges 41 by fasteners 46 extending between the housing 12 and the front face plate 42, such that the opposite side edges 39 of the lens 38 are held by the front face plate 42 against the outer step surfaces 40. The distance between the front plane and the inner recessed plane may be slightly less than a thickness of the lens 38, such that the side edges 39 of the lens 38 may be tightly clamped between the front face plate 42 and the outer step surfaces 40 when the front face plate 42 is drawn toward and/or against the front surfaces 44 by the fasteners 46.

As shown in FIGS. 3, 4, and 6, the forward edges 41 of the channel side walls 37 may include respective inner step surfaces 45 recessed from the outer step surfaces 40 and disposed in a common inner recessed plane spaced from and generally parallel to the inner recessed plane. As best shown in FIG. 4, the assembly 10 may include a reflector 48 sized so that opposite side edges 50 of the reflector 48 may be received on the inner step surfaces 45 where they can be sandwiched between the lens 38 and the inner step surfaces 45 to secure the reflector 48 in a desired position within the front channel 34 of the housing 12. The distance between the inner and outer recessed planes may be slightly less than a thickness of the opposite side edges 50 of the reflector 48, such that the opposite side edges 50 of the reflector 48 may be tightly clamped between the lens 38 and the inner step surfaces 45 when the front face plate 42 is drawn toward and/or against the front surfaces 44 by the fasteners 45. This arrangement prevents rattling or chattering noises from being generated by adjacent components during movement, and precludes any need for the use of secondary adhesion methods to secure the components against relative movement.

The front face plate 42 may comprise an aluminum die casting so that the front face plate 42 can readily be fabricated in a width and length corresponding to a selected width and length of the housing 12. As best shown in FIG. 3, the front face plate 42 may comprise at least one boss and preferably two bosses 52 disposed on respective inner-facing surfaces 51 of end walls 53 that extend integrally from a back surface 55 of the front face plate 42 at opposite ends of the front face plate 42. The bosses 52 may comprise respective threaded holes 54 configured to receive and threadedly engage threaded shafts of the fasteners 46.

The front face plate 42 may have a rectilinear shape sized to cover a panel hole 18 in which the assembly 10 is to be received. This allows the assembly 10 to be mounted in a panel hole 18 without leaving gaps showing between an inner edge of the hole 18 and an outer edge of the assembly 10. A panel hole 18, therefore, need not be cut to precisely match the dimensions of the assembly 10, and may be large enough to ease passage of the assembly during installation. The retainer spring clips 17 may be selected or fabricated to have spring clip arms 56 long enough to reach across and span gaps between the housing 12 and the hole 18.

As shown in FIGS. 1-5, the housing 12 may include at least one, but preferably two parallel spaced-apart longitudinal heat dissipation fins 58 integrally extending from a back surface 60 of the housing 12 opposite the floor 36 of the front channel 34 where the LEDs 14 are mounted. The fins 58 may be configured to reject LED-generated heat via conduction of heat energy from the LEDs 14 through the housing 12 to the fins and via convective heat transfer from the fins to ambient air. The fins 58 may be disposed directly opposite the LEDs 14 to improve heat rejection efficiency by minimizing heat conduction distance between the LEDs 14 and the fins 58. Additional fins 62 may extend from the back surface 60 of the housing 12 and may be spaced to either side of the fins 58 disposed generally opposite the LEDs 14. Preferably, all the fins 58, 62 may be formed with the housing 12 as a single unitary piece. In other embodiments, where heat rejection either isn't an issue or other means are employed to reject LED-generated heat, there may be fewer fins or no fins extending from the housing 12.

As shown in FIGS. 3, 4, and 6, the reflector 48 may comprise a series of rectangular annular reflector surface terraces 64, 66, 68 of increasing dimension extending diagonally forward and outward from a reflector inner edge adjacent and surrounding the LEDs 14, toward the forward edges 41 of the channel side walls 37. As best shown in FIG. 4, each of the reflector surface terraces 64, 66, 68 may have an arcuate cross-section, and may be shaped and positioned to assist in evening-out the concentration of light from the LEDs 14 across the lens 38 to provide a smooth, evenly-distributed rectangular light emission image across the lens 38. The lens 38 may be configured to further diffuse light received from the LEDs 14 and the lens 38.

Figure 9:
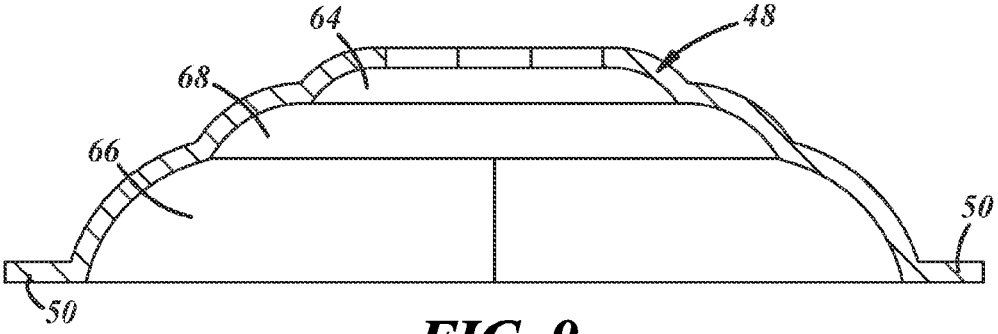
FIG. 9 is a cross-sectional view of a reflector of FIG. 7.
Figure 7:
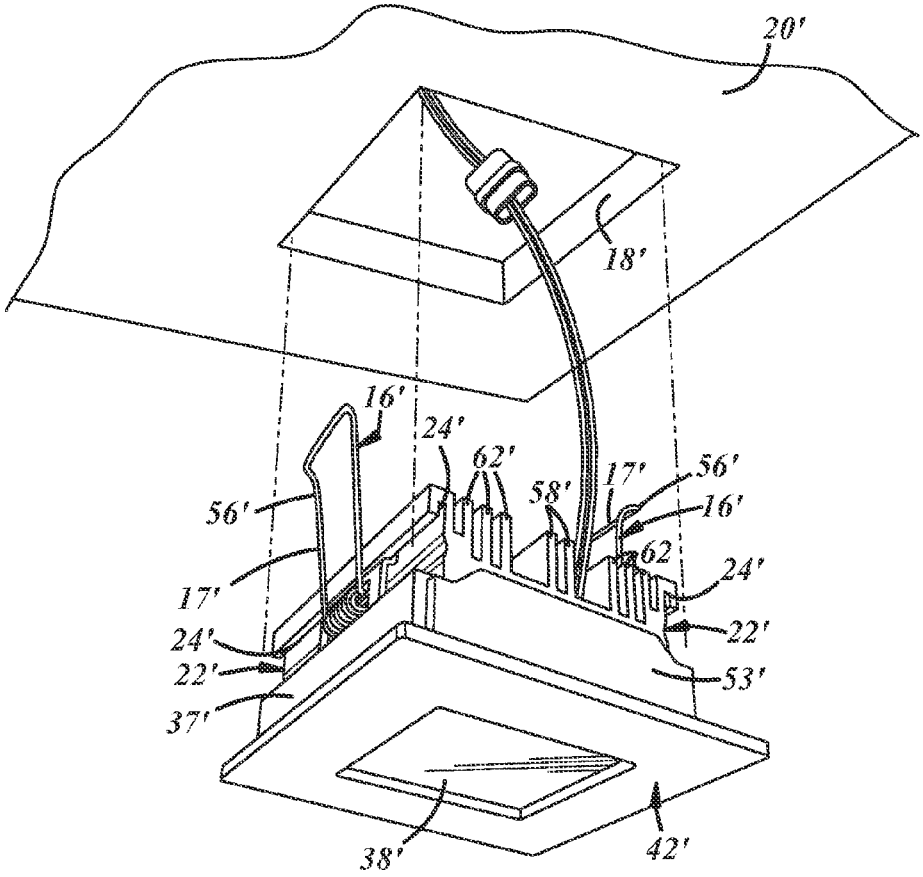
FIG. 7 is a perspective view of an elevator interior illumination assembly having a square housing and shown spaced below a square ceiling panel hole into which the assembly is to be received.
Figure 8:
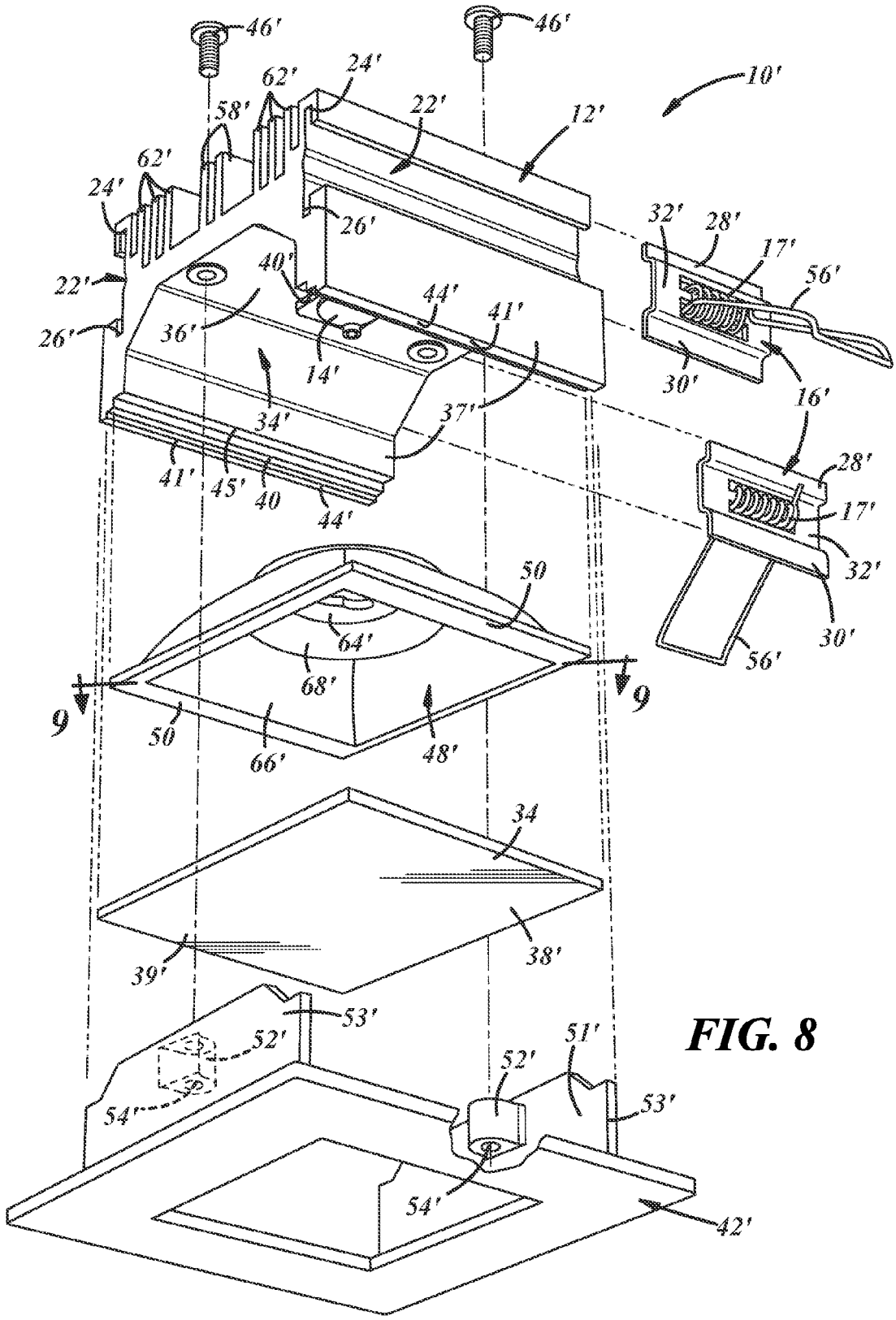
FIG. 8 is an exploded view of the assembly of FIG. 7.

According to the second embodiment shown in FIGS. 7-9, the assembly 10' may comprise a housing 12' that is cut to a length approximately equal to its width and that may carry a single LED 14' on its channel floor 36'. Accordingly, a front face plate 42' of the assembly 10' may be fabricated in a square shape having outer dimensions greater than those of the housing 12', and inner "window" dimensions less than those of the housing 12'. A lens 38' of the assembly 10' may also be fabricated or cut in a square shape, and may have outer dimensions slightly greater than the inner window dimensions of the front face plate 42'. As shown in FIGS. 8 and 9, a reflector 48' of the second embodiment assembly 10' may comprise an inner reflective surface 64' having a generally circular annular shape having an inner edge disposed adjacent and surrounding the LED 14'. The reflector 48' may also comprise an outer reflective surface 66' having a generally rectilinear annular shape having opposite outer edges disposed adjacent (and approximating the dimensions of) opposite channel side walls 37' of the housing 12'. Between the inner reflective surface 64' and the outer reflective surface 66' the reflector 48' may include a transition portion 68' that smoothly transitions from the circular annular shape of the inner reflective surface 64' to the rectilinear annular shape of the outer reflective surface 66'. As best shown in FIG. 9, the inner and outer reflective surfaces 64', 66', and transition portion 68' may have arcuate cross-sections. This reflector design precludes dark corners by permitting light to reach the corners, thus providing a consistent, evenly-distributed square light emission image across the lens 38'.

An elevator interior illumination assembly as described above provides even illumination from one or more LEDs across a rectilinear lens, and may be easily installed in a hole in an elevator ceiling panel.

This description, rather than describing limitations of an invention, only illustrates embodiments of the invention recited in the claims. The language of this description is therefore exclusively descriptive and is non-limiting. Obviously, it's possible to modify this invention from what the description teaches. Within the scope of the claims, one may practice the invention other than as described above.

What is claimed is:

1. An elevator interior illumination assembly for providing a rectilinear source of illumination in an elevator ceiling panel, the assembly comprising:

a housing carrying at least one LED and including a front channel;

a reflector carried by the housing;

a rectilinear lens carried by the housing and closing the front channel, the lens being sandwiched against opposite forward edges of the channel side walls by a front face plate; and the reflector and lens being configured to direct light emitted by the LED into an evenly-distributed rectilinear light emission image across the lens.

2. An elevator interior illumination assembly as defined in claim 1 in which:

at least one retainer is carried by the housing and adapted to secure the housing in a hole in a panel; and the housing includes at least one side channel configured to receive the retainer.

3. An elevator interior illumination assembly as defined in claim 2 in which the side channel comprises an elongated track configured to receive 2 or more retainers.

4. An elevator interior illumination assembly as defined in claim 1 in which the retainer comprises a spring clip.

5. An elevator interior illumination assembly as defined in claim 1 in which the at least one LED is carried on a floor of the front channel. channel side walls by a front face plate.

6. An elevator interior illumination assembly as defined in claim 5 in which the lens is sealed against the opposite forward edges of the channel side walls by the front face plate.

7. An elevator interior illumination assembly as defined in claim 5 in which the lens comprises a polycarbonate sheet.

8. An elevator interior illumination assembly as defined in claim 5 in which:

the forward edges of the channel side walls include:

respective front surfaces disposed in a common front plane; and respective outer step surfaces recessed from the front surfaces and disposed in a common inner recessed plane spaced from and generally parallel to the front plane; and opposite side edges of the lens are received in the outer step surfaces and sandwiched between the front face plate and the outer step surfaces; and the front face plate is engaged against the front surfaces.

9. An elevator interior illumination assembly as defined in claim 8 in which the distance between the front plane and the inner recessed plane is slightly less than a thickness of the lens.

10. An elevator interior illumination assembly as defined in claim 5 in which the front face plate is an aluminum die casting.

11. An elevator interior illumination assembly as defined in claim 5 in which the front face plate comprises at least one boss disposed on a back surface of the front face plate and configured to engage a fastener.

12. An elevator interior illumination assembly as defined in claim 5 in which the front face plate has a rectilinear shape sized to cover a panel hole in which the assembly is to be received.

13. An elevator interior illumination assembly as defined in claim 8 in which:

the forward edges of the channel side walls include respective inner step surfaces recessed from the outer step surfaces and disposed in a common second recessed plane spaced from and generally parallel to the inner recessed plane; and opposite side edges of the reflector are received in the inner step surfaces and sandwiched between the lens and the inner step surfaces.

14. An elevator interior illumination assembly as defined in claim 1 in which the housing includes at least one longitudinal heat dissipation fin integrally extending from a back surface of the housing opposite the floor of the front channel and opposite a location for mounting at least one LED.

15. An elevator interior illumination assembly comprising:

a housing carrying an LED; and a reflector carried in a channel of the housing and comprising:

an inner reflective surface having a circular annular shape having an inner edge disposed adjacent and surrounding the LED, an outer reflective surface having a rectilinear annular shape, and a transition portion that smoothly transitions from the circular annular shape of the inner reflective surface to the square annular shape of the outer reflective surface.

16. An elevator interior illumination assembly as defined in claim 15 comprising retainers adapted to secure the housing in a hole in a panel.

17. An elevator interior illumination assembly as defined in claim 16 in which the housing has a front channel configured to carry LEDs and to be closed by a lens sandwiched against opposite forward edges of the channel side walls by a front face plate.

18. An elevator interior illumination assembly as defined in claim 17 in which the forward edges of the channel side walls each include first and second steps configured to receive and position the lens and front face plate.

19. An elevator interior illumination assembly as defined in claim 18 in which each of the forward edges of the channel side walls includes a third step configured to receive and position a reflector.

20. An elevator interior illumination assembly as defined in claim 17 in which at least one longitudinal fin integrally extends from a back surface of the housing opposite the front channel floor.

* * * * *